United States Patent [19]

Inagaki et al.

[11] Patent Number: 4,769,275

[45] Date of Patent: Sep. 6, 1988

[54] COATED CLOTH

[75] Inventors: Yutaka Inagaki, Kawanishi; Susumu Yamada, Toyama; Saburo Fukushima, Suita, all of Japan

[73] Assignee: Kawasaki Jukogyo Kabushiki Kaisha, Kobe, Japan

[21] Appl. No.: 15,631

[22] Filed: Feb. 17, 1987

[30] Foreign Application Priority Data

Feb. 15, 1986 [JP] Japan ..... 61-31148

[51] Int. Cl.[4] ..... B32B 5/16

[52] U.S. Cl. ..... 428/240; 428/241; 428/242; 428/244

[58] Field of Search ..... 428/240, 241, 242, 244

[56] References Cited

U.S. PATENT DOCUMENTS

| | | | |
|---|---|---|---|
| 3,981,831 | 9/1976 | Markusch et al. | 521/122 X |
| 4,214,026 | 7/1980 | Ibata et al. | 428/67 |
| 4,352,897 | 10/1982 | Ogata et al. | 523/220 |
| 4,391,667 | 7/1983 | Vangbo et al. | 428/72 X |

*Primary Examiner*—Thurman K. Page

*Attorney, Agent, or Firm*—Schwartz & Weinrieb

[57] ABSTRACT

A coated cloth, wherein a blend containing from 50 to 400 parts by weight of a hydroxide and more than 3 parts by weight of powdery fibers based on 100 parts by weight of a base polymer not containing halogen elements is coated on a cloth. The coated cloth is excellent in abrasion resistance and flame retardance, as well as releasing less smoke.

12 Claims, 1 Drawing Sheet

COATED CLOTH

FIELD OF THE INVENTION

This invention concerns coated cloth for use in seats and hoods of railroad vehicles and the likes.

BACKGROUND OF THE INVENTION

Flame-retardant coated cloth for use in buildings, vehicles or the like have been prepared, for example, by appending a synthetic leather 1 mainly composed of polyvinyl chloride (hereinafter simply referred to as PVC) to a cloth substrate 2, for example, as shown in FIG. 2.

However, since such conventional coated cloth includes PVC synthetic leather contains chlorine (halogen) atoms in the molecular structure of the PVC and such halogen compound is less combustible, the PVC blend for use in the synthetic resin releases toxic gaseous hydrogen oxide upon combustion and results in the disintegration of the blend upon combustion due to the low melting viscosity at high temperature. Accordingly, the PVC coated cloth in the prior art has exhibited a problem with respect to human life safety and security upon occurrence of fire accidents and, therefore, cannot satisfy the standards required for practical use enforcement shown in Table 1.

TABLE 1

Specific examples of standards required for the blend coated on the cloth, among the items required therefor

| Required Item | Required property | Test method | brief description of the test method |
|---|---|---|---|
| (1) Abrasion resistance | not destroyed after 20000 cycles | *1 5304 | specimen of 48 mm width is subjected to parallel friction with enamel paper under 8.9N load |
| (2) Color fastness | no color migration (in both dry and wet cases) | *1 5651 | specimen is put to 20 cycle friction with standard white cloth under 9N/500 $m^2$ load |
| (3) Combustibility | less than 10 sec | *2 | specimen is put to Bunzen |
| 1. Flame residual time time | | FAA-DOT 25853 | burner flame at 1550° F. for 12 sec and combustibility is observed |
| 2. Propagation distance | less than 150 mm | | |
| 3. Dropping | none | | |
| (4) Smoke generation amount | less than 250 | ASTM E-662 | specimen is heat decomposed and the smoke generation amount is determined quantitatively by light permeation techniques |
| (5) Blend composition | containing no toxic substance such as chlorine or lead compound | no particular designation | chemical analysis |

*1 Federal Standard FED-STD-191A

*2 Federal Aviation Administration

OBJECT OF THE INVENTION

The object of this invention is to provide a coated cloth that neither releases toxic gases nor causes hot droplets upon the occurrence of fire accidents.

SUMMARY OF THE INVENTION

The foregoing object of this invention can be attained by means of a coated cloth, wherein a blend comprising from 50 to 400 parts by weight of a hydroxide and more than 3 parts by weight of powdery fibers based on 100 parts by weight of a base polymer not containing halogen elements is coated on a cloth substrate.

BRIEF DESCRIPTION OF THE ACCOMPANYING DRAWINGS

These and other objects, as well as advantageous features of this invention will become apparent by reading the following description for a preferred embodiment according to this invention while referring to the accompanying drawings, wherein FIG. 1 is a cross sectional view for the coated cloth according to this invention and FIG. 2 is a cross sectional view for the coated cloth in the prior art.

DESCRIPTION OF THE PREFERRED EMBODIMENT

Figure 1:
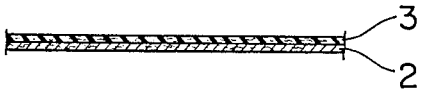
Figure 2:
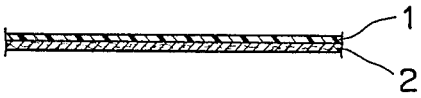
FIG. 2 PRIOR ART

FIG. 1 is a cross sectional view illustrating one embodiment of this invention in which a blend 3 according to this invention is coated on a cloth substrate. The properties required for the coated cloth include bonding strength and tensile strength of the blend 3 and the cloth 2, tensile strength and tear strength for the stitched portion and the like, in addition to those set forth in Table 1. The properties equal to those in the prior art can be provided by using conventional method and selecting appropriate cloth and method of bonding.

EXAMPLE

The properties shown in Table 1 are determined by the blend coated upon the cloth substrate and they were tested for the blending ratios shown in Table 2.

TABLE 2

| Blending part | Blending agent | Blending ratios of the blend — Type of mixture A | B | C | D | E | F | G | H |
|---|---|---|---|---|---|---|---|---|---|
| Base polymer | Acrylic rubber | 100 | 100 | 100 | 100 | 100 | — | — | 100 |
| | Ethylene-vinyl acetate resin | — | — | — | — | — | 100 | 100 | — |
| Pigment | Carbon black | 3 | 3 | 3 | 3 | 3 | 3 | 3 | 3 |
| Plasticizer | DOP | 5 | 5 | 5 | 5 | 5 | 30 | 30 | 5 |
| Filler | Aluminum hydroxide | 30 | 50 | 50 | 50 | 500 | 100 | 200 | 400 |
| Powdery fiber | Phenol resin | — | — | 1 | 3 | 3 | — | 30 | 3 |
| Vulcanizer | Hexamethylene diamine | 3 | 3 | 3 | 3 | 3 | — | — | 3 |

Note 1: numerical value is represented by weight bases
Note 2: phenol resin powder size: 2 denier (diameter) × 0.2 mm (length) (Kainole fiber powder manufactured by Nippon Kainol K.K.)

TABLE 3

| Test results of the coated cloth with blend — Property Characteristics | Kind of blend used for the coated cloth A | B | C | D | E | F | G | H |
|---|---|---|---|---|---|---|---|---|
| (1) Abrasion resistance | x | x | x | o | x | x | o | o |
| (2) Color fastness | o | o | o | o | o | o | o | o |
| (3) Combustibility (overall judgement) | x | o | o | o | o | x | o | o |
| 1. Flame residual time | x | o | o | o | o | o | o | o |
| 2. Propagation distance | x | o | o | o | o | o | o | o |
| 3. Dropping | o | o | o | o | o | x | o | o |
| (4) Smoke generation amount | o | o | o | o | x | o | o | o |
| Overall estimation | x | x | x | o | x | x | o | o |

Note: o pass. x failed

Explanation will now be made as to the contents of the experiment. Each of the blends (A–H) of the compositions shown in Table 2 was sufficiently mixed on a four inch roll and coated by press bonding to a cloth, woven from polyamide fiber threads of 420 denier both for wraps and wefts 25 threads per inch width, to the entire thickness of 0.6 mm so as to prepare a coated cloth.

The blend-coated cloths A–E and H incorporated with the vulcanizer were further maintained in an oven at 150° C. for 60 minutes so as to achieve vulcanization of the blends. Table 3 shows the results of the performance tests in Table 1, and cloths D, G, and H pass the overall estimation.

As can be estimated from the results, the blend-coated cloth containing more than fifty parts by weight of aluminum hydroxide based upon one hundred parts by weight of the base polymer is improved with respect to the combustibility for the flame residual time and the propagation distance. However, if it is blended by more than five hundred parts by weight, excess smoke is generated (in this case, steam).

The combustibility can be improved by the blending of aluminum hydroxide due to the steam generated at high temperature, and similar effects can also be obtained by means of other hydroxides, such as, for example, magnesium hydroxide. Still further, a hydroxysalt, such as, $2Al_2(OH)_3$, $Mg(OH)_2$, or an aquocomplex salt such as $CaCl_2$—$6H_2O$, $Na_2SO_3$—$7H_2O$, or the like, as well as sodium sulfite, can also be utilized.

If the phenol resin is blended with more than three parts by weight of the powdery fiber, the abrasion resistance can be improved in the case of an acylic rubber base polymer and the abrasion resistance and dropping or disintegration property during combustion can be improved in the case of an ethylene-vinyl acetate resin type base polymer. It can be considered that these improvements can in fact be obtained in view of the fact that the aforenoted powdery fibers present on the surface of the blends can protect the surface against the friction with the object causing friction.

It is also considered that the dropping tendency or deleterious disintegration of the coated cloth can be improved, because the powdery fibers tighten the structure of the blends. Accordingly, other powdery fibers having such function, for example, polyamide resins, polyester resins, metal and ceramic materials can also provide similar effects. For selecting the powdery material, it is necessary that those powder materials having higher hardness than the base polymer (hardness after the vulcanization, if it is vulcanized) should be selected.

Table 4 shows the results of the abrasion tests for a sheet of about 1 mm thickness prepared by the same procedures as the blending contents for the test results.

TABLE 4

| Part of the blending agent | Blending agent (weight ratio) | Type of mixture I | J | K | L | M |
|---|---|---|---|---|---|---|
| Base polymer | natural rubber | 50 | | | | |
| | SBR | 50 | | | | |
| Lubricant | stearic acid | 1 | | | | |
| | paraffin | 2 | | | | |
| Vulcanization promotor | zinc oxide | 5 | | | | |
| Pigment | carbon black | 3 | | | | |
| Plasticizer | naphthetnic oil | 20 | | | | |
| Filler | aluminum hydroxide | 150 | | | | |
| | silicon oxide | 30 | | | | |
| Vulcanizer system | sulfur | 2 | | | | |
| | tetramethylthiuram disulfide | 2 | | | | |
| Powdery Fiber (Ground or milled fibers) | Polyester (3 denier × 3 mm) | — | 10 | — | — | — |
| | Polyamide (1.5 denier × 3 mm) | — | — | 10 | — | — |
| | $Al_2O$—$SiO_2$ (3 mm dia × 5 mm) | — | — | — | 10 | — |
| | Al (0.1 mm dia × 2 mm) | — | — | — | — | 10 |
| Reduction by the taper abrasion tester (mg) (condition: H-38 abrasion wheel, 500g load, 1000 rpm) | | 108 | 34 | 38 | 23 | 21 |

In the foregoing experiments, although acrylic rubber, natural rubber, SBR and ethylene-vinyl acetate resin have been used as the base polymer, abrasion resistance can be improved by using any one of other base polymers so long as they uphold the principles of this invention, and the base polymer can be selected while considering the degree of required performance and the cost. The base polymer may be natural rubber, styrene-butadiene rubber, nitrile-butadiene rubber, acrylic rubber, ethylene-propylene rubber, butyl rubber, silicone rubber ethylene-vinyl acetate resin, ethyle-vinyl acrylate resin or the like in view of the experiences in the past and the aforementioned experiments but they are in no way restricted only thereto as described above.

As has been described above, according to this invention, since a cloth substrate is coated with a blend not containing halogen elements and excellent in the abrasion resistance and combustion properties, if a fire accident should occur in vehicles or buildings installed with seats or the like using the coated cloth according to this invention, the coated cloth will not propagate the fire, and neither releases toxic gas nor results in the formation of hot droplets. Accordingly, it can provide an advantageous effect of enhancing human safety and security and providing more extensive working life than the prior art products due to the excellent abrasion resistance.

Obviously, many modifications and variations of the present invention are possible in light of the above teachings. It is therefore to be understood that within the scope of the appended claims, the present invention may be practiced otherwise than as specifically described herein.

What is claimed is:

1. A coated cloth, comprising:
a cloth substrate; and
a blend, not containing halogen elements and comprising greater than 30 and less than 500 parts by weight of either a material which is thermally decomposable so as to release water, a hydrated salt, or a hydroxide; a base polymer; and more than 1 part by weight of powdery fibers based upon 100 parts by weight of said base polymer, coated upon said cloth substrate.

2. A coated cloth as defined in claim 1, wherein:
the powdery fibers are at least one selected from the group consisting of phenol resin, polyamide resin, polyester resin, metal, or ceramic.

3. A coated cloth as defined in claim 1, wherein:
the hydroxide is either aluminum hydroxide or magnesium hydroxide.

4. A coated cloth as set forth in claim 1, wherein:
said material is a hydroxysalt.

5. A coated cloth as set forth in claim 4, wherein:
said hydroxysalt is $2Al_2(OH)_3$.

6. A coated cloth as set forth in claim 4, wherein:
said hydroxysalt is $Mg(OH)_2$.

7. A coated cloth as set forth in claim 4, wherein:
said material is an aquocomplex salt.

8. A coated cloth as set forth in claim 7, wherein:
said aquocomplex salt is $CaCl_2—6H_2O$.

9. A coated cloth as set forth in claim 7, wherein:
said aquocomplex salt is $Na_2SO_3—7H_2O$.

10. A coated cloth as set forth in claim 1, wherein:
said material is sodium sulfite.

11. A coated cloth as set forth in claim 1, wherein:
said base polymer is selected from the group consisting of acrylic rubber, natural rubber, styrene-butadiene rubber, and ethylene-vinyl acetate resin.

12. A coated cloth as set forth in claim 1, wherein:
said base polymer is selected from the group consisting of natural rubber, styrene-butadiene rubber, nitrile-butadiene rubber, butyl rubber, silicone rubber, ethylene-propylene rubber, acrylic rubber, ethylene-vinyl acetate resin, and ethylene-vinyl acrylate resin.

* * * * *